US008944116B2

(12) United States Patent
Jaruse, Sr.

(10) Patent No.: US 8,944,116 B2
(45) Date of Patent: Feb. 3, 2015

(54) LENO HEDDLE

(71) Applicant: Rome Division Rummel Fibre Co., Inc., Rome, GA (US)

(72) Inventor: Robert Jaruse, Sr., Rome, GA (US)

(73) Assignee: Rome Division Rummel Fibre Co., Inc., Rome, GA (US)

( * ) Notice: Subject to any disclaimer, the term of this patent is extended or adjusted under 35 U.S.C. 154(b) by 49 days.

(21) Appl. No.: 13/788,278

(22) Filed: Mar. 7, 2013

(65) Prior Publication Data

US 2014/0251489 A1 Sep. 11, 2014

(51) Int. Cl.

| | |
|---|---|
| ***D03C 7/02*** | (2006.01) |
| ***D03C 9/06*** | (2006.01) |
| *D03C 7/00* | (2006.01) |
| *D03C 9/00* | (2006.01) |

(52) U.S. Cl.

CPC ..... *D03C 7/02* (2013.01)
USPC ..... 139/52; 139/51; 139/91

(58) Field of Classification Search

CPC ..... D03C 7/00; D03C 7/02; D03C 7/06; D03C 7/08; D03C 11/00; D03C 9/02; D03C 1/10; D03C 7/005; D03C 9/0633; D03C 13/00; D03D 19/00; D03D 47/40; D03D 5/00
See application file for complete search history.

(56) References Cited

U.S. PATENT DOCUMENTS

| | | | | | |
|---|---|---|---|---|---|
| 648,573 | A | * | 5/1900 | Patterson | 139/52 |
| 776,300 | A | * | 11/1904 | Cowan | 139/51 |
| 1,037,151 | A | * | 8/1912 | Kaufmann | 139/52 |
| 1,050,734 | A | * | 1/1913 | Hamer | 139/52 |
| 2,691,389 | A | | 10/1954 | Thorpe | |
| 3,015,346 | A | * | 1/1962 | Kaufmann | 139/52 |
| 3,016,924 | A | * | 1/1962 | Wagner | 139/51 |
| 3,058,495 | A | * | 10/1962 | Kaufmann | 139/51 |
| 3,353,569 | A | * | 11/1967 | Koch | 139/51 |
| 3,990,481 | A | * | 11/1976 | Graf | 139/52 |
| 4,572,241 | A | * | 2/1986 | Kramer | 139/52 |
| 4,967,802 | A | * | 11/1990 | Klocker | 139/51 |
| 4,987,928 | A | * | 1/1991 | Gaisser | 139/52 |
| 5,040,571 | A | * | 8/1991 | Klocker et al. | 139/52 |
| 5,127,444 | A | * | 7/1992 | Takano et al. | 139/52 |
| 6,102,080 | A | * | 8/2000 | Hockemeyer et al. | 139/52 |
| 6,116,291 | A | * | 9/2000 | Hockemeyer et al. | 139/51 |
| 6,230,756 | B1 | | 5/2001 | Baumann et al. | |
| 6,955,191 | B2 | * | 10/2005 | Hockemeyer et al. | 139/52 |
| 7,131,465 | B1 | | 11/2006 | Chapman | |

* cited by examiner

*Primary Examiner* — Bobby Muromoto, Jr.
(74) *Attorney, Agent, or Firm* — Lerner, David, Littenberg, Krumholz & Mentlik, LLP

(57) ABSTRACT

A leno heddle includes a pair of elongated shanks, which are removably assembled together in overlying relationship. One of the shanks has configured ends to be removably received within corresponding openings in the other shank. The shank having configured ends can be replaced within the leno heddle without having to remove the other shank from its coupled relationship with the loom's upper and lower leno heddle support bars.

24 Claims, 6 Drawing Sheets

LENO HEDDLE

BACKGROUND OF THE INVENTION

The present invention relates in general to a heddle adapted for use in mechanical looms, and more particularly, to leno heddles for use in combination with dupe heddles for producing a leno weave.

A loom is a machine used to weave together warp and weft threads to make fabric. There are known a number of mechanical looms which produce various woven patterns having different characteristics. One such loom is referred to as a leno loom for producing a leno weave. A leno weave is a weave in which two warp threads are twisted around the weft thread to provide a strong fabric. The twisted warp threads grip tightly about the weft thread which produces a durable fabric with almost no thread slippage or misplacement of threads, particularly suitable for use in carpet backing material. To produce a leno weave, the loom is threaded with the shuttle weft thread and the dupe warp threads. The dupe warp threads can be of similar or lesser weight and strength to the weft thread. The weft thread is woven into the shed, and for each weft shuttle, the warp threads are twisted interchangeably to produce a figure eight pattern.

Two of the many mechanical components of the leno loom for weaving the warp and weft threads are the leno heddle and the dupe heddle. By way of example, a typical leno loom includes a pair of leno heddles, which are interconnected at a medial location by the dupe heddle. The leno heddle includes a pair of elongated shanks coupled together forming a space therebetween for receiving a portion of the dupe heddle. The ends of the leno heddle include eyelets for coupling the heddle to an upper and lower heddle support bar. The heddle support bar is received within the eyelets for positioning the heddles within the leno loom during the weaving operation. The pair of shanks may be maintained in an assembly relationship by interfitting elements, such as disclosed in Kramer, U.S. Pat. No. 4,572,241.

The number of leno heddles used in a leno loom varies depending upon the width of the fabric being woven. It is not unusual to have hundreds of leno heddles attached to the heddle support bars within the leno loom. Like other machine parts, the heddles are subject to wear and breakage, especially at their eyelet ends. When such a heddle has broken, it has heretofore been necessary to stop the loom, and remove the broken heddle for replacement. This can be particularly difficult and time-consuming when the broken heddle is in the middle of other heddles, which may have to be removed from the heddle support bars before the broken heddle can be replaced. To overcome this problem, there is known from Thorpe, U.S. Pat. No. 2,691,389, a repair head which can be attached to the upper end of the heddle shank after removal of the broken eyelet end. The repair head, however, is typically bulky compared to the original heddle shank, and in general, can catch on the other adjacent heddles during operation of the loom.

SUMMARY OF THE INVENTION

In accordance with one embodiment of the invention, there is disclosed and described a heddle for a loom, comprising an elongated first shank having spaced apart ends and an opening therebetween; and an elongated second shank overlying the first shank, the second shank having spaced apart ends releasably attached to the first shank and a transition region extending through the opening in the first shank.

The ends of the second shank are attached to the first shank inwardly of the ends of the first shank. The first shank includes first and second sides, the second shank having a first leg between one end thereof and the transition region overlying the first side of the first shank and a second leg between the other end thereof and the transition region overlying the second side of the first shank.

One end of the first shank includes an opening having a shape and one end of the second shank has a corresponding shape, wherein the shape comprises a T-shape. Another end of the first shank includes an opening having a shape and another end of the second shank has a corresponding shape, wherein the shape comprises a rectangular shape. The first shank has a length generally greater than a length of the second shank.

In accordance with another embodiment of the invention, there is disclosed and described a heddle for a loom, comprising an elongated first shank having opposing first and second sides, spaced apart ends, and an opening therebetween; an elongated second shank passing through the opening of the first shank and having a first leg overlying the first side of the first shank and a second leg overlying the second side of the first shank, the second shank having spaced apart ends releasably attached within respective openings provided inwardly of the ends of the first shank.

In accordance with still another embodiment of the invention, there is disclosed and described a heddle for a loom, comprising an elongated first shank having first and second spaced apart ends, a first heddle support bar opening adjacent the first end of the shank, a second heddle support bar opening adjacent the second end of the shank, a first shank opening adjacent the first heddle support bar opening, a second shank opening adjacent the second heddle support bar opening, and a third opening between the first and second shank openings; and an elongated second shank having third and fourth spaced apart ends and a transition region therebetween, wherein when the first and second shanks are assembled, the third end of the second shank is removably received within the first shank opening and the fourth end of the second shank is removably received with the second shank opening with the transition region passing through the third opening.

The first shank includes first and second sides, the second shank having a first leg between the third end thereof and the transition region overlying the first side of the first shank and a second leg between the fourth end thereof and the transition region overlying the second side of the first shank.

The first end of the first shank includes an opening having a shape and the third end of the second shank has a corresponding shape, wherein the shape comprises a T-shape. The second end of the first shank includes an opening having a shape and the fourth end of the second shank has a corresponding shape, wherein the shape comprises a rectangular shape.

BRIEF DESCRIPTION OF THE DRAWINGS

Various embodiments of the present invention will now be described with reference to the appended drawings. It is appreciated that these drawings depict only exemplary embodiments of the invention and are therefore not to be considered limiting of its scope.

DETAILED DESCRIPTION

Figure 1:
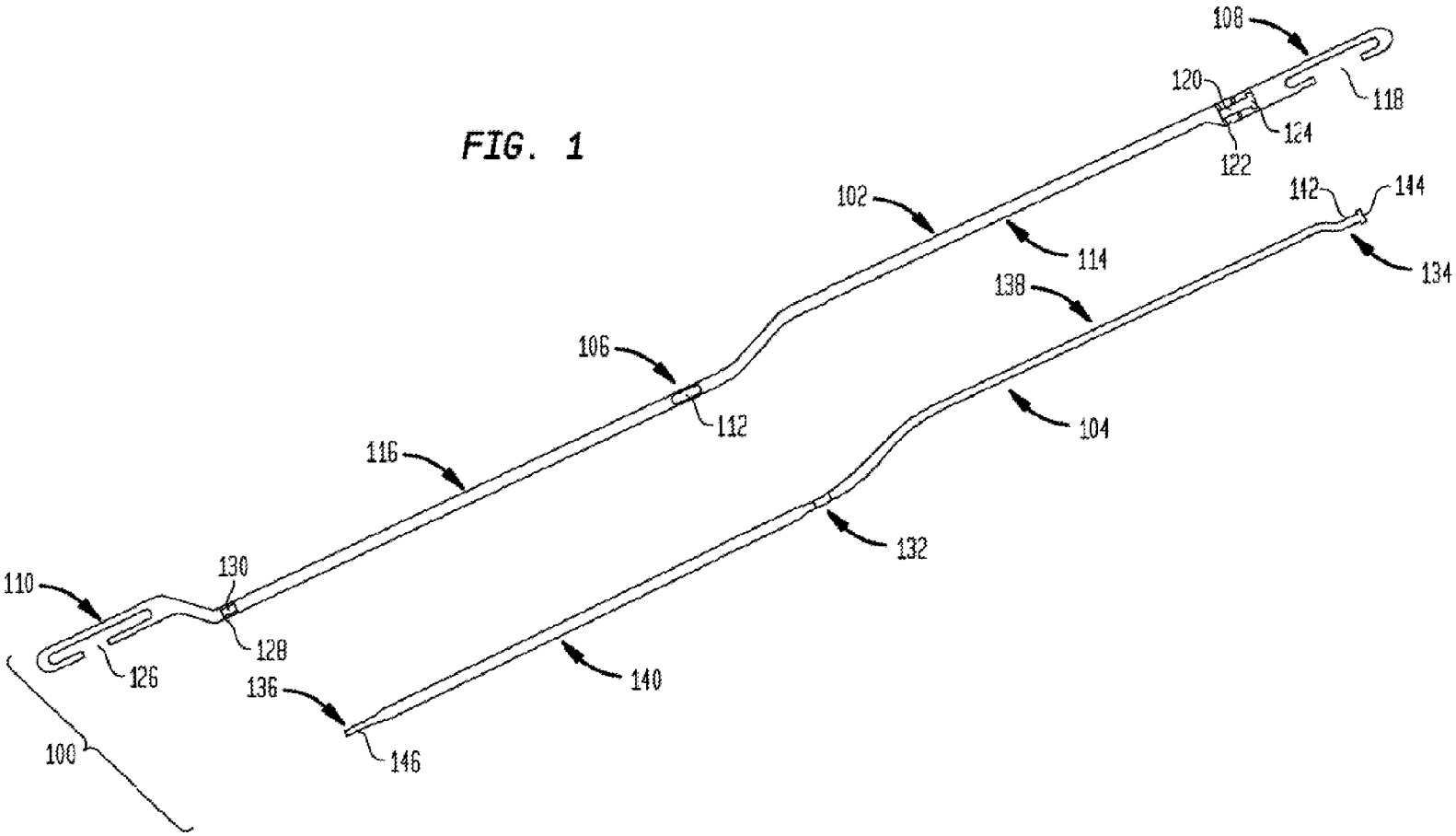
FIG. 1 is a top plan view of an unassembled leno heddle formed from a pair of elongated shanks.

In describing the preferred embodiments of the invention illustrated in the drawings, specific terminology will be used for the sake of clarity. However, the invention is not intended to be limited to the specific terms so used, and it is to be understood that each specific term includes all equivalents that operate in a similar manner to accomplish a similar purpose.

Referring to the drawings wherein like reference numerals represent like elements, there is shown in FIG. 1 a leno heddle in unassembled relationship and generally designated by reference numeral 100. The leno heddle may be referred to hereinafter as simply the heddle 100. The heddle 100 includes an elongated configured first shank 102 and an elongated configured second shank 104 as shown in unassembled relationship. By way of example, the shanks 102, 104 may be made from 301 stainless steel having a thickness of about 0.023 inches. The shanks 102, 104 can be fabricated using various machine techniques, for example, laser cutting, stamping, progressive tooling, and the like.

Shank 102 includes a transition region in the area generally designated by reference numeral 106 and a pair of spaced apart ends generally designated by reference numerals 108 and 110. The transition region 106 includes an opening 112, which although shown and described as rectangular, may be of other shapes such as geometric or nongeometric as will be understood from a further description of the present disclosure. The shank section extending generally from the transition region 106 to the end 108 defines a first leg 114. In a like manner, the shank section extending generally from the transition region 106 to the second end 110 forms a second leg 116. The first end 108 may be formed with a C-shaped opening 118 having its longitudinal axis extending in the longitudinal direction of the first leg 114. In addition to a C-shaped opening 118, the opening may also be of other shapes, for example, J-shaped, circular or oval shaped, and the like. Various shaped openings are shown in Baumann et al., U.S. Pat. No. 6,230,756, the disclosure of which is incorporated herein by reference.

Figure 2:
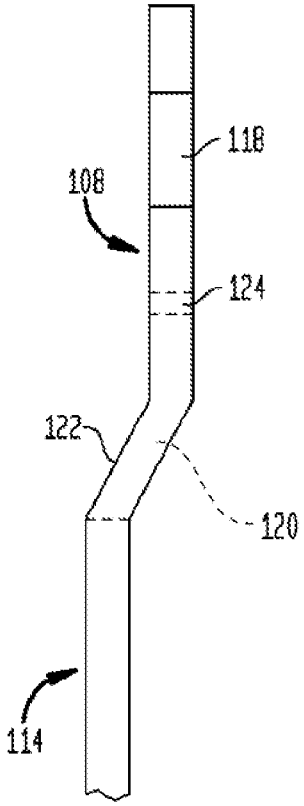
FIG. 2 is a side elevational view of one end of the first shank.

A configured opening 120 is provided in leg 114 inwardly adjacent opening 118. By way of one example, the opening 120, as shown in FIGS. 1 and 2, has a T-shape. In this regard, the leg 114 includes an angled portion 122 adjacent the first end 108. The configured opening 120 is formed within the angled portion 122 extending into the first end 108. The T-shape of the configured opening 120 is formed by the opening having an enlarged rectangular end 124. Although shown and described as T-shaped, the opening 120 may be of other shapes as will be understood from a further description of the present disclosure. For example, any shape that will perform a similar function to capture and retain the end of the second shank 104, as to be described, may be used.

Figure 3:
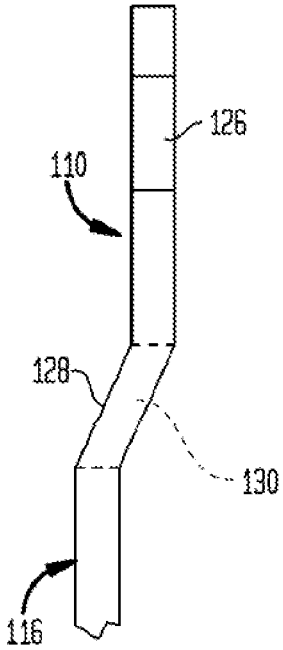
FIG. 3 is a side elevational view of the other end of the first shank.

Referring to FIGS. 1 and 3, second end 110 likewise may include a C-shaped opening 126 having its longitudinal axis extending in the longitudinal direction of the second leg 116. Here again, although shown as a C-shaped opening 126, the opening can also have other shapes, such as J-shaped, circular or oval shaped, and the like. The second leg 116, inwardly of the second end 110, includes an angled portion 128 having an opening 130. The opening 130, although illustrated as rectangular, can have other geometric or nongeometric shapes which will be understood from a further description of the present disclosure.

The second shank 104, as shown in FIG. 1, includes a transition region of reduced width generally designated by reference numeral 132 and a pair of space apart first and second ends generally designated by reference numerals 134 and 136. A first leg 138 is generally defined extending between the transition region 132 and the first end 134. Likewise, a second leg 140 is generally defined extending between the transition region 132 and the second end 136. The transition region 132 is configured at an angle such that the first and second legs 138, 140 are arranged extending generally in parallel spaced apart planes, See FIG. 4. The first end 134 may be configured to have a shape corresponding to the shape of the opening 120, by way of example, a T-shape. In this example, the T-shape is formed by a main body 142 having an enlarged rectangular head 144 thereby representing the letter T. Other shapes are contemplated as will be understood from a further description of the present disclosure. For example, any shape that will perform a similar function to be captured and retained by the opening 120 in the first shank 102 may be used. The size of the T-shaped first end 134 is generally slightly smaller than the size of the corresponding T-shaped opening 120. The second end 136 of the second shank 104 includes an elongated extending tab 146. Although the tab 146 is shown as having a generally rectangular shape, other shapes are contemplated as will be understood from the following description of the present disclosure.

Figure 4:
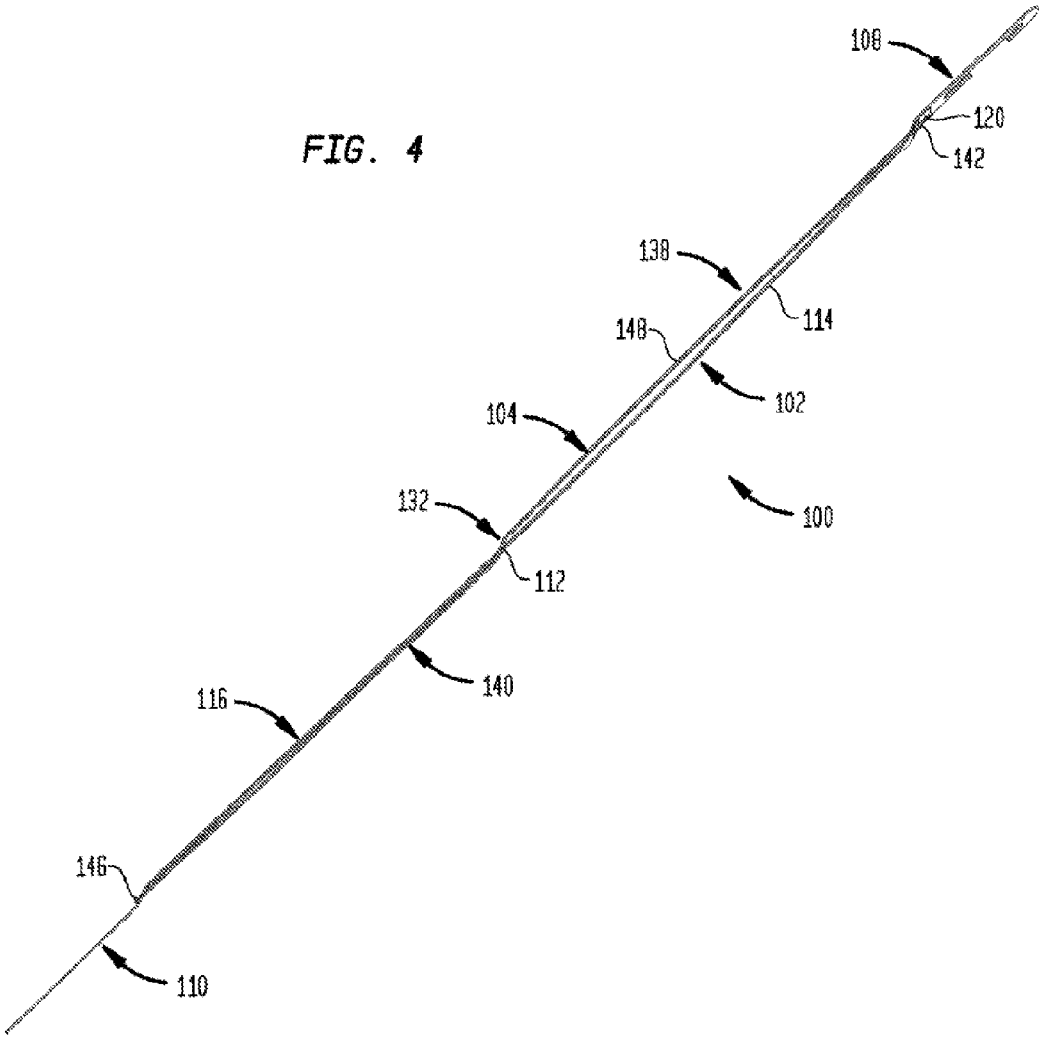
FIG. 4 is a top plan view of the leno heddle of FIG. 1 shown in assembled relationship.
Figure 5:
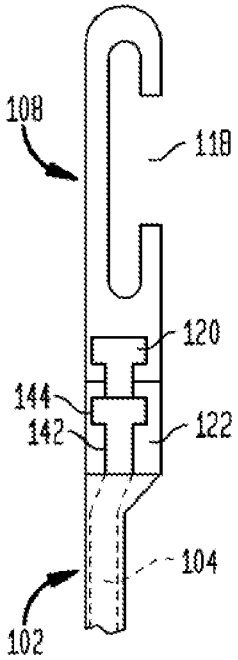
FIG. 5 is a top plan view of one end of the leno heddle in assembled relationship as shown in FIG. 4.
Figure 6:
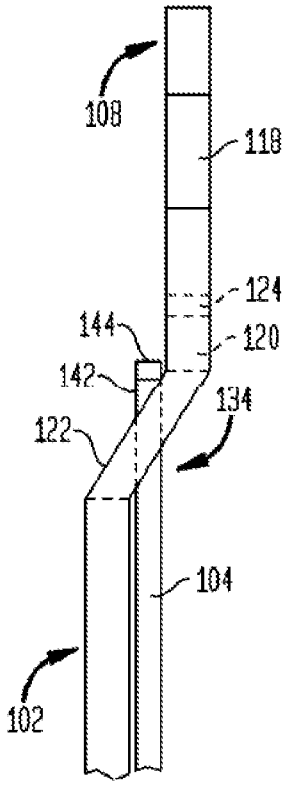
FIG. 6 is a side elevational view of the assembled end of the leno heddle as shown in FIG. 5.

Referring now to FIGS. 4-6, there is shown the first and second shanks 102, 104 in assembled relationship to form a leno heddle 100 by way of one example. The second shank 104 is inserted through the opening 112 in the first shank 102 until aligned with the transition region 132, with the first and second legs 138, 140 arranged in parallel offset planes on opposite sides of the first shank 102. In this regard, as shown in FIG. 4, the first leg 138 of the second shank 104 is arranged overlying and in alignment with one side of the first leg 114 of the first shank 102, while the second leg 140 of the second shank is arranged overlying and in alignment with the opposite side of the second leg 116 of the first shank. The legs 114, 138 of the first and second shanks 102, 104 provide a slight space 148 therebetween for receiving a portion of the dupe heddle as to be described hereinafter.

Referring more specifically to FIGS. 5 and 6, the first end 134 of the second shank 104 is releasably attached to the first end 108 of the first shank 102. In this regard, the T-shaped end 142, 144 of the second shank 104 is first aligned overlying the corresponding T-shaped opening 120 in the first shank 102. The T-shaped end 142,144 is passed through the T-shaped opening 120, and then, longitudinally moved in a direction away from the first end 108 of the first shank 102 until the enlarged head 144 of the T-shaped end is stopped by portions of the first shank 102 formed by the angled portion 122. The enlarged head 144 by abutting the angled portion 122 precludes the second shank 104 from sliding longitudinally toward the second end 110 of the shank 102.

Figure 7:
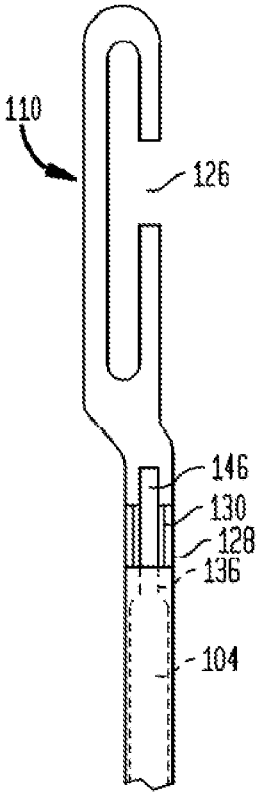
FIG. 7 is a top plan view of the other end of the leno heddle as shown in assembled relationship in FIG. 4.

Referring to FIG. 7, the second end 136 of the second shank 104 is similarly releasably attached to the second end 110 of the first shank 102. In this regard, the tab 146 of the second shank 104 is inserted through the opening 130 within the angled portion 128 of the first shank 102. The tab 146 extends beyond the extent of the opening 130, overlying a portion of the second end 110 of the first shank 102 adjacent opening 126, completing the assembly of the leno heddle 100.

Figure 8:
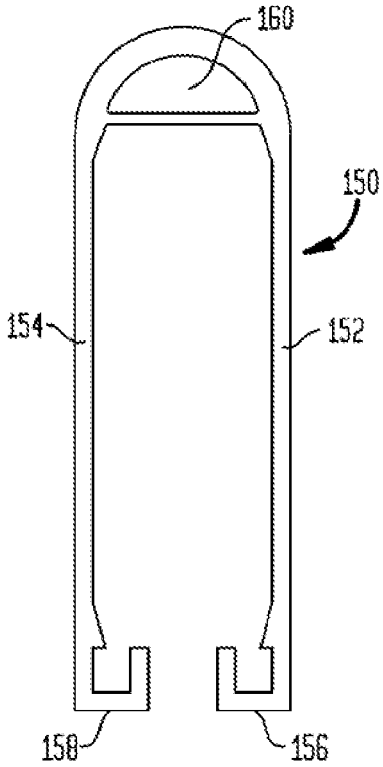
FIG. 8 is a top plan view of a dupe heddle.

The assembled leno heddle 100 may be used with a dupe heddle for forming a leno weave. A dupe heddle 150, by way of one example, is shown in FIG. 8. The dupe heddle 150 includes a pair of spaced apart elongated legs 152, 154, which terminate at respective J-shaped ends 156, 158. The other ends of the legs 152, 154 form an eyelet 160 adapted for receiving the warp thread to be twisted about the weft thread during the weaving process. Another example of a dupe heddle 150 is disclosed in Hockemeyeer et al., U.S. Pat. No. 6,116,291.

Figure 9:
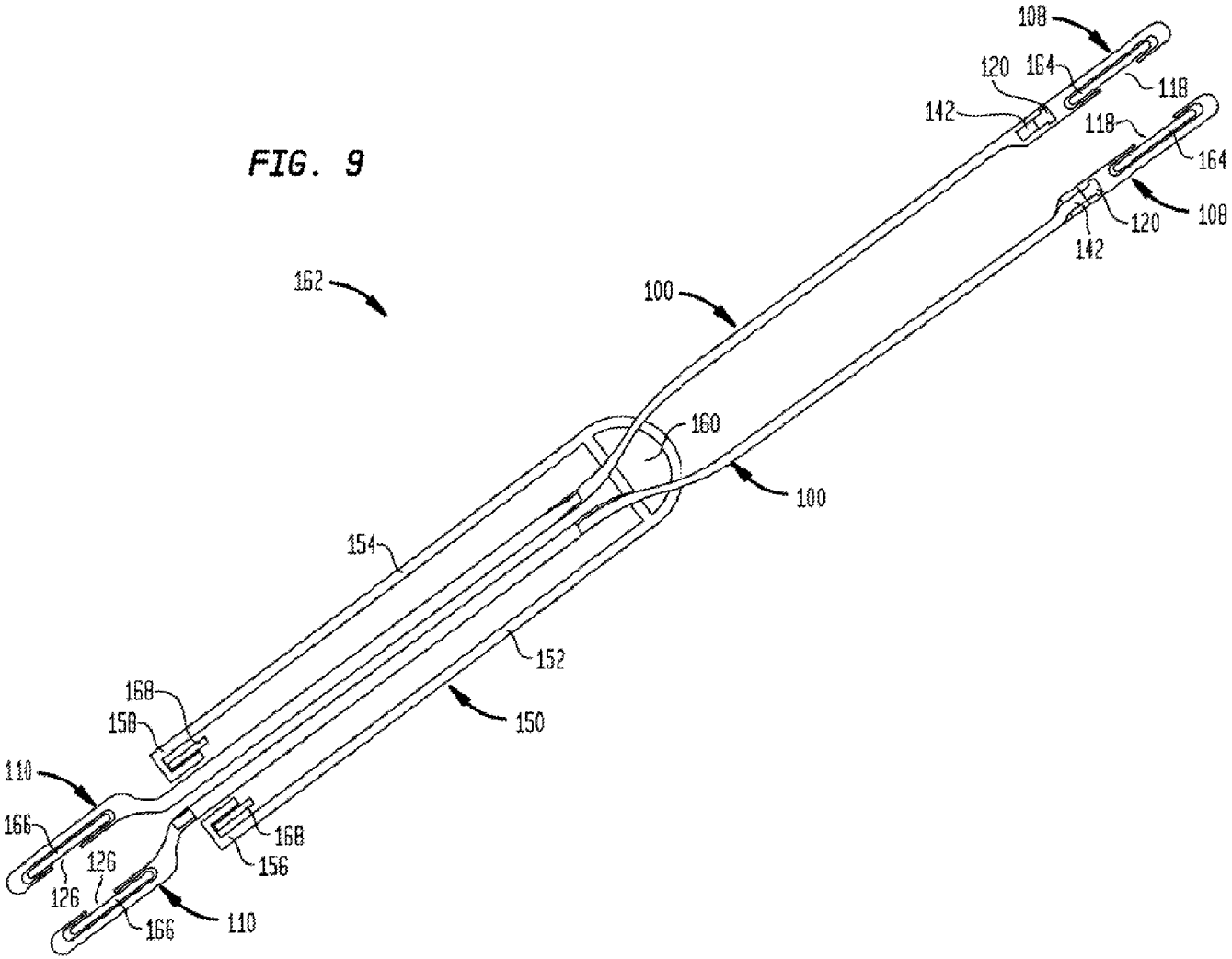
FIG. 9 is a top plan view of a leno heddle assembly including a pair of leno heddles and a dupe heddle.

Referring now to FIG. 9, there is shown a leno heddle assembly 162 for use in a mechanical loom for producing a leno weave using the leno heddles 100 in accordance with the present invention. A pair of leno heddles 100 are arranged side by side in alignment with one another. The upper ends 108 of the heddles 100 are slidably supported by upper leno heddle support bars 164 via the openings 118. Likewise, the second ends 110 of the heddles 100 are slidingly supported by lower leno heddle support bars 166 via the openings 126. The legs 153, 154 of the dupe heddle 150 are passed through the space 148 formed between the assembled shanks 102, 104. The legs 152, 154 extend longitudinally and outwardly of the shanks 102, 104 with the J-shaped ends 156, 158 positioned adjacent the ends 110 of the leno heddles 100. The J-shaped ends 156, 158 receive dupe heddle support bars 168. The use of a leno heddle assembly 162 in a leno loom for forming a leno weave is considered known to those having ordinary skill in the art. Accordingly, a description of using the leno heddles in a leno loom is not required for a complete understanding of the construction and operation of the leno heddles in accordance with the present disclosure.

As previously noted, a leno loom may include hundreds of leno heddles 100 arranged as shown in FIG. 9. The second shank 104 can be easily and quickly removed and replaced from within the heddle with minimal loom downtime by reversing the assembly procedure described hereinabove. In this regard, it is not required that the entire leno heddle 100 be removed from the upper and lower heddle support bars 164, 166.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A heddle for a loom, comprising:

an elongated first shank having spaced apart ends and an intermediate opening therebetween, wherein one end of the first shank includes a first opening and another end of the first shank includes a second opening; and an elongated second shank overlying the first shank, the second shank having spaced apart first and second ends releasably attached to the first shank and a transition region between the spaced apart first and second ends extending through the intermediate opening in the first shank, wherein the first end is received within the first opening and the second end is received within the second opening.

2. The heddle of claim 1, wherein the first and second ends of the second shank are attached to the first shank within the first and second openings inwardly of the ends of the first shank.

3. The heddle of claim 2, wherein the first shank includes first and second sides, the second shank having a first leg between one end thereof and the transition region overlying the first side of the first shank and a second leg between the other end thereof and the transition region overlying the second side of the first shank.

4. The heddle of claim 3, wherein the first opening has a shape and the first end of the second shank has a corresponding shape.

5. The heddle of claim 4, wherein the shape comprises a T-shape.

6. The heddle of claim 4, wherein the second opening has a shape and the second end of the second shank has a corresponding shape.

7. The heddle of claim 6, wherein the shape comprises a rectangular shape.

8. The heddle of claim 1, wherein the first shank has a length greater than a length of the second shank.

9. The heddle of claim 1, wherein the ends of the first shank include a heddle support bar opening.

10. A heddle for a loom, comprising:

an elongated first shank having opposing first and second sides, spaced apart ends, and an opening therebetween;

an elongated second shank passing through the opening of the first shank and having a first leg overlying the first side of the first shank and a second leg overlying the second side of the first shank, the second shank having spaced apart ends releasably attached within respective openings provided inwardly of the ends of the first shank.

11. The heddle assembly of claim 10, wherein the second shank has a transition region between the ends thereof passing through the opening of the first shank.

12. The heddle of claim 11, wherein one end of the first shank includes an opening having a shape and one end of the second shank has a corresponding shape.

13. The heddle of claim 12, wherein the shape comprises a T-shape.

14. The heddle of claim 12, wherein another end of the first shank includes an opening having a shape and another end of the second shank has a corresponding shape.

15. The heddle of claim 14, wherein the shape comprises a rectangular shape.

16. The heddle of claim 11, wherein the first shank has a length greater than a length of the second shank.

17. The heddle of claim 11, wherein the ends of the first shank include a heddle support bar opening.

18. A heddle for a loom, comprising:

an elongated first shank having first and second spaced apart ends, a first heddle support bar opening adjacent the first end of the shank, a second heddle support bar opening adjacent the second end of the shank, a first shank opening adjacent the first heddle support bar opening, a second shank opening adjacent the second heddle support bar opening, and a third opening between the first and second shank openings; and an elongated second shank having third and fourth spaced apart ends and a transition region therebetween, wherein when the first and second shanks are assembled, the third end of the second shank is removably received within the first shank opening and the fourth end of the second shank is removably received with the second shank opening with the transition region passing through the third opening.

19. The heddle of claim 18, wherein the first shank includes first and second sides, the second shank having a first leg between the third end thereof and the transition region overlying the first side of the first shank and a second leg between the fourth end thereof and the transition region overlying the second side of the first shank.

20. The heddle of claim 19, wherein the first end of the first shank includes an opening having a shape and the third end of the second shank has a corresponding shape.

21. The heddle of claim 20, wherein the shape comprises a T-shape.

22. The heddle of claim 20, wherein the second end of the first shank includes an opening having a shape and the fourth end of the second shank has a corresponding shape.

23. The heddle of claim 22, wherein the shape comprises a rectangular shape.

24. The heddle of claim 18, wherein the first shank has a length greater than a length of the second shank.

* * * * *